US008040254B2

(12) United States Patent
Delia et al.

(10) Patent No.: US 8,040,254 B2
(45) Date of Patent: Oct. 18, 2011

(54) METHOD AND SYSTEM FOR CONTROLLING AND ADJUSTING TRAFFIC LIGHT TIMING PATTERNS

(75) Inventors: David J. Delia, Lagrangeville, NY (US); Wayne M. Delia, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 367 days.

(21) Appl. No.: 12/349,216

(22) Filed: Jan. 6, 2009

(65) Prior Publication Data

US 2010/0171640 A1 Jul. 8, 2010

(51) Int. Cl.
*G08G 1/095* (2006.01)

(52) U.S. Cl. ..... 340/907; 340/906; 701/117

(58) Field of Classification Search ..... 340/907, 340/906, 917, 934; 701/117, 213
See application file for complete search history.

(56) References Cited

U.S. PATENT DOCUMENTS

| | | | | |
|---|---|---|---|---|
| 3,613,073 | A | 10/1971 | Emerson | |
| 5,257,194 | A | 10/1993 | Sakita | |
| 5,357,436 | A | 10/1994 | Chiu | |
| 5,917,432 | A | 6/1999 | Rathbone | |
| 5,973,616 | A * | 10/1999 | Grebe et al. | 340/906 |
| 6,427,113 | B1 * | 7/2002 | Rahman | 701/117 |
| 6,633,238 | B2 | 10/2003 | Lemelson et al. | |
| 2002/0116118 | A1 | 8/2002 | Stallard et al. | |
| 2003/0210156 | A1 | 11/2003 | Nishimura | |
| 2006/0155427 | A1 | 7/2006 | Yang | |
| 2007/0273552 | A1 | 11/2007 | Tischer | |
| 2008/0234920 | A1 * | 9/2008 | Nurminen | 701/117 |
| 2009/0005984 | A1 * | 1/2009 | Bradley | 701/213 |
| 2009/0040069 | A1 * | 2/2009 | Afzulpurkar et al. | 340/934 |

OTHER PUBLICATIONS

Cherrill, et al., Online Traffic Model Correction from Sensor Counts, p. 1660 (Doc. No. CCC73C002055), Oct. 1973.
Cherrill, et al. p. 1659, (Doc. No. CCC73C002054), Oct. 1973.

* cited by examiner

*Primary Examiner* — John A Tweel, Jr.
(74) *Attorney, Agent, or Firm* — George R. McGuire; Frederick JM Price; Bond Schoeneck & King

(57) ABSTRACT

The present invention relates to methods and systems for controlling and adjusting traffic light timing patterns, and more particularly, to a method and system for controlling and adjusting traffic light timing patterns based on input variables related to known or predicted events, and for gradually changing traffic light intervals over time.

18 Claims, 6 Drawing Sheets

METHOD AND SYSTEM FOR CONTROLLING AND ADJUSTING TRAFFIC LIGHT TIMING PATTERNS

BACKGROUND

1. Field of the Invention

The present invention relates to methods and systems for controlling and adjusting traffic light timing patterns, and more particularly, to a method and system for controlling and adjusting traffic light timing patterns based on input variables related to known or predicted events, and for gradually changing traffic light intervals over time.

2. Description of the Related Art

Traffic light sequences/phases are computer-controlled and are generally timed according to a fixed schedule to accommodate common patterns of traffic flow, such as a green light for a long duration on major roads, with a correspondingly shorter duration for the intersecting minor roads. Changes to traffic light timing patterns are nearly exclusively enabled by designated time intervals, in which a discrete change is made from one timing pattern to another in response to regularly scheduled events such as weekday rush hour traffic periods.

Various methods and systems for controlling traffic light timing patterns exist. Five specific types of conventional methods and systems for controlling traffic light timing patterns include "fixed time control," "dynamic control," "time of day/special events," "coordinated control," "actuated control," and "preemption," each of which are discussed in further detail below. For each type, the timing cycle of the affected traffic light is changed in a discrete manner, i.e., either a regularly scheduled time interval based-change, or an abrupt change from one timing cycle to a different timing cycle.

"Fixed time control" is the simplest and most common system for controlling traffic signal timing patterns. Fixed time control is based on a fixed mechanical cycle in which the duration of each individual light (e.g., red light and green light phases of the cross street and the main street directions of an intersection) is constant. This system has no ability to improve the flow of traffic during times of heavy traffic flow over the course of a day.

A fixed time control system traffic signal timing pattern may be altered by a control system that is programmed to change the traffic signal timing pattern based on time of day or in a "special events" situation. For example, at night when there is less typically traffic, a green light phase may be set for a longer duration in the main street direction compared with the same green light phase's daily duration. Additionally, during a special event when an increase in traffic flow is anticipated, a green light phase, for example, may be set for a longer duration in the main street direction compared with the same green light phase's typical daily duration. These alterations in the fixed time control system traffic signal timing pattern represent abrupt and discrete changes effected for a specific time of day, or for a one-time or special event.

"Dynamic control" is a system designed to alter the fixed traffic signal timing patterns established by the fixed time control system. This system alters the fixed traffic signal timing patterns via, e.g., automobile sensors (electronic detector loops) embedded in the road. Automobiles waiting at an intersection in front of a red light are sensed by the sensors. These sensors send a signal to a traffic signal controller, which effects a change in the fixed traffic signal timing pattern converting the red light to green prior to the normal conversion time established by the fixed time control system. This system requires special equipment and expensive installation procedures, and does not extend the length of traffic light duration (e.g., green light phase in the heavy traffic flow direction) to accommodate known or planned increases in traffic. In short, it is noted that a "dynamic control" system requires real time sensors which provide the system with traffic volume data at the time it occurs. Before this point in time, no traffic volume information is available or known to the present system.

"Coordinated control" is a system designed to improve traffic flow by timing subsequent lights to be green ("cascading") so that automobiles obeying the speed limit typically do not encounter any red lights for a long distance. This system is most effective in times of constant levels of traffic flow. This system is not as effective during times of anticipated increases in entering or exiting traffic volume. In fact, a system of coordinated control of traffic lights along a main road may be an obstacle to overcome in the case of a scheduled event producing irregular traffic patterns due to anticipated volume increases. Some systems can coordinate traffic lights in real time in response to increases in traffic flow. However, these systems require a large number of sensors and/or video cameras and are very expensive.

"Actuated control" is a system that includes a button that can be pressed by pedestrians at a pedestrian crossing to alter the traffic signal timing pattern. For example, this system is manually initiated by a pedestrian pressing a button to request a red light in the main street direction in order to cross a cross street safely, and to activate red lights and traffic gates at a railroad crossing.

"Preemption" systems (e.g., 3M Opticon system) are configured to allow a traffic signal timing pattern to be interrupted by certain priority traffic, such as emergency vehicles. These systems include sensors on or near the traffic signal, and are configured to receive signals from transmitters attached to the emergency vehicle that send strobe light, radio waves, audio, and/or infrared signals to the sensor. Upon initiation, the normal traffic signal timing pattern is preempted, i.e., a red light is changed to a green light in the direction of the emergency vehicle, while the cross street light is changed to red. This system is no longer used in some places, because it has been illegally replicated and used by non-emergency workers. Neither the actuated nor the preemption system applies to alterations of traffic signal durations for any more than a one-time change.

In FIG. 1, a flowchart F100 illustrating a conventional traffic light control system is shown. Data flow relating to the same is also shown. The traffic light control application system 160 is shown interconnected to a plurality of input modules. Each of the input modules are programmed and/or structured to cause the traffic light control application system module 160 to effectuate an abrupt, discrete change(s) to traffic light operations 170. The input modules include a standard traffic light timing schedule input module 130 (including static timing schedules which are in effect the majority of the time), time-based overrides input module 150 (including discrete changes which take effect over a pre-defined time interval such as rush hour), and traffic light manual override capability input module 140. The traffic light manual override capability input module 140 is interconnected to three manual override input modules, including event manual override input module 105 (e.g., manual overrides by event traffic control personnel for a "special event" as described above), emergency vehicle activation manual override input module 110, and lane sensor manual override input module 120. The input modules also include a traffic light infrastructure database input module 200, which includes a database of traffic light locations and default timing schedules as an input to the traffic light control application system 160. Data transferred from any one of these input modules to the traffic light control application system 160 results in abrupt, discrete changes in traffic light operations 170.

In FIG. 2, a flowchart F200 illustrating a conventional method for controlling a set of traffic lights based on an output of an algorithm is shown, including steps S210, S220, and S230.

UK Nos. 8730016 and 8730015 ("Cherrill et. al.") each disclose a traffic control system which employs a model which shows, for each road intersection, the predicted vehicle arrivals over each of a number of periods, for example, 32 four-second periods. The vehicle arrival figures are used, in conjunction with traffic light pattern indications to develop vehicle queue figures, and these are utilized to optimize the traffic light patterns to minimize delay at each intersection. The model is constructed by projecting predicted patterns of vehicles leaving the intersections, to generate predicted vehicle arrivals at downstream intersections. When used in an online mode, the predicted vehicle arrival figures for the first few periods of each intersection arrival pattern are continuously replaced by predicted vehicle arrival figures obtained from vehicle sensors located upstream of the intersections. The arrival figures derived from the sensors are noted as the most accurate, and the accuracy of each predicted arrival pattern decreases as the prediction period increases. Two suggestions are made to compensate for this lowered accuracy for the long-term portions of the arrival predictions. First, the sensor counts, before replacing the corresponding predicted arrival figures, are compared with these figures to produce a flow correction factor. This correction factor represents the actual average flow of vehicles approaching an intersection over the predicted average flow of these vehicles. The predictions for each intersection are then corrected by multiplying them by the corresponding flow correction factor. Second, the queue date derived from the arrival predictions is differently weighed before it is used to optimize the light settings, these weightings diminishing from the earliest to the most future predictions.

In short, it is noted that Cherrill et. al. shows the continuous replacement of vehicle arrival predictions that forms an iterative refinement of the model, which requires the use of upstream traffic sensor equipment.

U.S. Pat. No. 6,633,238 (Lemelson et. al.) describe a system and method for controlling traffic and traffic lights, and selectively distributing warning messages to the motorists. The method described relies on a system of traffic sensing devices to determine current, real time traffic volume, and includes GPS (Global Positioning Satellite) technology to assist in communication of traffic-related messages to vehicle drivers and to dynamic traffic message display devices. Lemelson et. al. disclose as an object of the invention to select particular fuzzy logic inference rules for traffic light control based on particular conditions that may affect traffic flow such as weather or predicted unusual traffic conditions such as those that might be encountered with special events such as major sport attractions. The Lemelson et. al. system provides that outside factors may influence the decisions of the fuzzy logic expert system. Such outside factors may include inclement weather, an accident at a nearby intersection, or special event traffic patterns (i.e. sporting events, concerts, etc.).

It is noted that Lemelson et. al. describe the use of "fuzzy logic," as referenced above, to alter the synchronization of traffic signals to adapt to detected changes in real time traffic patterns. The information tracked and collected is not known in advance to the system. As an example, suppose it is known that a major sold out rock concert is scheduled for a certain venue, date, time, and duration, after which an expected volume of traffic will be exiting the venue, following a typical statistical distribution. The system and method taught by Lemelson et. al. would not be aware of this expected disruption in normal traffic patterns until it was actually happening and detected in real-time.

Description Of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

SUMMARY

It is therefore a principal object and advantage of the present invention to provide a system and method for controlling and adjusting traffic light timing patterns to improve the flow of traffic during times of predicted increases in traffic flow.

It is a further object and advantage of the present invention provide a system and method for controlling and adjusting traffic light timing patterns to smoothly accommodate gradual buildup of traffic based on known event end times and approximated traffic buildup distribution curves.

It is another object and advantage of the present invention to provide a system and method for controlling and adjusting traffic light timing patterns to accommodate special events in response to a statistical analysis of projected traffic volumes based on standard deviations from a scheduled point in time. These events can include, but are not limited to 1) a sporting event, 2) a musical concert, 3) a political rally, 4) a play, opera, or other cultural event, 5) traffic exiting an airport after large flights arrive, and 6) a funeral procession.

It is a further object and advantage of the present invention to provide a method and system which gradually increases a first timing signal of a traffic light to a second timing signal (e.g., red to green, green to red) in anticipation of known or expected surges in traffic volume. An embodiment of the present invention takes advantage of known event plans and other input parameters/variables which would generate spikes in traffic volume around the time of the end of the event, as traffic exits the venue's parking lots. Moreover, an embodiment of the present invention is programmed and/or structured to calculate demand on subsequent "downstream" traffic lights which would need to be adjusted to optimize the exit traffic flow along common routes away from the venue. For example, suppose there's a primary traffic light at an intersection closest to the event venue, from which three different routes can be taken. Subsequent traffic lights are located further down each of those three routes. Changes to the timing schedule of the original traffic lights can be propagated to the subsequent traffic lights along the route based on statistical distributions of known or predicted events.

It is another object and advantage of the present invention to provide a system and method for controlling and adjusting traffic light timing patterns, which provides automatic, statistical distribution-based improvement of traffic control before and after an event, based on the event schedule, anticipated attendance, and anticipated traffic volume, with a possibility of a significant reduction of on-the-scene traffic enforcement people overriding the fixed functionality of individual traffic lights near the event venue.

It is another object and advantage of the present invention to provide a system and method for controlling and adjusting traffic light timing patterns that is predictive rather than reactive/responsive. In other words, it is an object an advantage of an embodiment of the present invention to provide a system that does not require any kind of traffic volume detectors, traffic sensor equipment or devices, GPS navigation devices, cameras and the like, and/or any other real-time sensors or detectors, or any communication protocols between a central application system and either vehicles or interactive traffic message display devices in proximity. An embodiment of the present invention can operate without any of these devices, and is not directed to communicating messages to vehicle drivers, or manipulating the displayed messages on traffic information signs (while many of the previously described conventional devices would not work without those devices). This is because information regarding a planned event with expected volumes of traffic may be entered in the system of an embodiment of the present invention in advance of the planned event by event traffic control personnel, administrators, or attendants following a typical statistical distribution of traffic at a particular time.

It is a further object and advantage of the present invention to provide a system and method for controlling and adjusting traffic light timing patterns that is based on pre-designated expected estimates of future traffic volumes and patterns resulting from scheduled events, such as an expected spike in traffic volume occurring around the end of a major sporting event.

It is another object and advantage of the present invention to provide a system and method for controlling and adjusting traffic light timing patterns that drives changes to traffic patterns based on expected, pre-specified volume estimates that are input to the system in a certain time frame in advance, e.g., hours to days in advance or longer.

In accordance with the foregoing objects and advantages, an embodiment of the present invention provides a traffic light control system for controlling a first traffic light, which includes an input variable module structured and/or programmed to receive and/or determine a plurality of input variables; and a traffic light control algorithm module structured and/or programmed to receive the input variables from the input variable module, to determine light status control information for the first traffic light, and to output the light status control information to the first traffic light to control operation of the first traffic light; wherein the plurality of input variables includes at least a first event prediction related variable. The first event prediction related variable can include information related to an event date, event time, event location, expected event attendance, first vehicle access arrival frequency variable, and/or expected event traffic volume. The first event prediction related variable can also include a particular statistical distribution curve, such as a normal statistical distribution curve or a beta-distribution curve. The plurality of input variables can include at least a second event prediction related variable, which can include a second vehicle access arrival frequency variable.

In accordance with an embodiment of the present invention, a traffic light control system for controlling a first traffic light is structured and/or programmed to apply input parameters characterizing the expected traffic patterns at a particular location, and gradually change at least the first traffic light timing sequence near the exits and entrances of event venues, for example, based on known or expected traffic volumes and statistical distributions. Input parameters/variables and updates can be supplied to the system (which could be run by a local municipality, i.e., a highway department of public works) by authorized event administrators. Authorized adjustments to the input parameters can be permitted in the case of schedule changes or updates, such as extra innings of a baseball game, a late concert start, etc.

As noted, input parameters related to an event can include, but are not limited to, the scheduled date and start/end time of an event, expected attendance, expected vehicular traffic, and traditional statistical distributions. These input parameters can be combined with infrastructure information such as venue location, traffic light location, downstream traffic light propagation effects, and the like to produce a gradually increasing and gradually decreasing timing pattern to optimize expected variable traffic levels before and after events. Several different heavily traveled access and exit routes in the immediate vicinity can be identified and specifically identified traffic lights can be adjusted to account for an expected distribution of bursts of increased traffic before and after the event. A known or estimated standard deviation can be calculated, estimated, or provided as input. For example, based on an event ending at 8:30 PM, the data can be analyzed and standard deviations calculated to expect a certain traffic level at a nearby traffic light beginning at 8:35 PM and ending at 8:50 PM, whereby the system adjusts the traffic light duration accordingly.

In accordance with a further embodiment of the present invention, a traffic light control system for controlling a first traffic light is provided, which includes an input variable module structured and/or programmed to receive and/or determine a plurality of input variables; and a traffic light control algorithm module structured and/or programmed to receive the input variables from the input variable module, to determine light status control information for the first traffic light, and to output the light status control information to the first traffic light to control operation of the first traffic light. The light status control information effectively determines a traffic light cycle, a plurality of traffic light intervals occurring within each traffic light cycle and a plurality of interval delta values according to the plurality of traffic light intervals. During at least some portions of normal operations, the traffic light control algorithm can determine light status control information so at least one of the plurality of traffic light intervals changes in an at least a minimally continuous manner, at least a moderately continuous manner, or at least a very continuous manner.

In accordance with another embodiment of the present invention, a method of controlling accumulation of vehicular traffic at an intersection is provided. The method can include the steps of: providing data concerning a first access to the intersection; providing data concerning a second access to the intersection; calculating a first vehicle access arrival frequency function for vehicles entering the intersection from the first access and a second vehicle access arrival frequency function of vehicles entering the intersection from the second access; providing a control mechanism to control vehicles leaving the intersection from the first access and the second access, the control mechanism having a control function; and modifying the control function based on changes to the first vehicle access arrival frequency function. The first access to the intersection can be the direction affected by an expected and/or predicted increase in traffic volume (i.e., "main direction"). The second access to the intersection can be the crossroad direction to the intersection (i.e., "crossroad direction").

The control mechanism can include a traffic light control system (as described herein) that controls the traffic light in the main and/or crossroad directions. For example, the control mechanism can control a green light interval in the crossroad direction to (1) remain the same length as in the main direction, (2) decrease in some kind of proportion to a scheduled increase in duration for the main direction, or (3) can be arbitrarily configurable by, e.g., a traffic authority administrator or attendant who is entering the change in duration for the main direction. The crossroad direction traffic light interval can be an additional parameter that can be forecast/predicted and/or entered into or determined by the traffic light control system, depending on anticipated/predicted traffic volumes in the crossroad direction.

BRIEF DESCRIPTION OF THE SEVERAL VIEWS OF THE DRAWINGS

The present invention will be more fully understood and appreciated by reading the following Detailed Description in conjunction with the accompanying drawings, in which.

DETAILED DESCRIPTION

Figure 1:
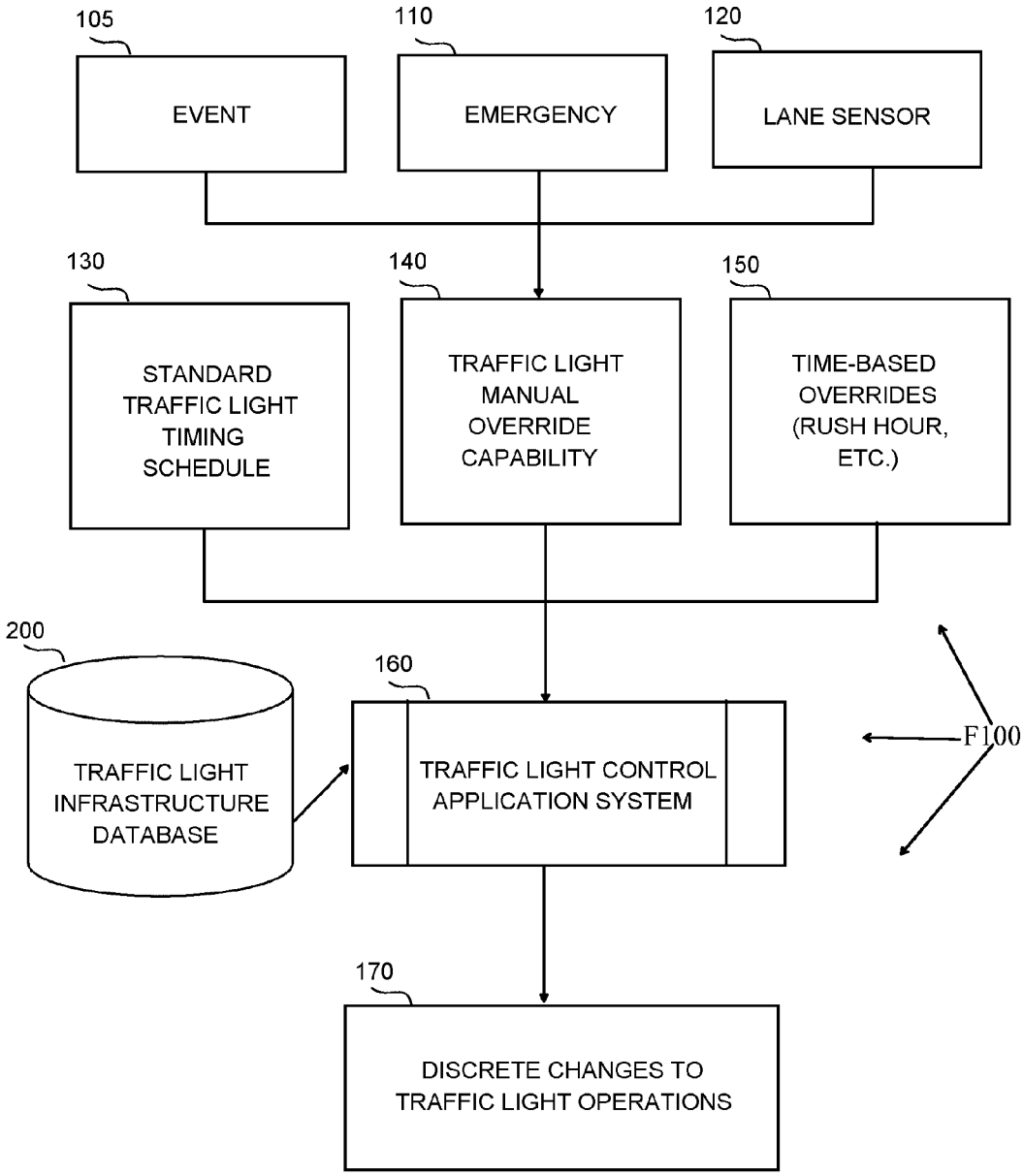
FIG. 1 PRIOR ART
FIG. 1 is a flowchart illustrating a conventional traffic light control system.
Figure 2:
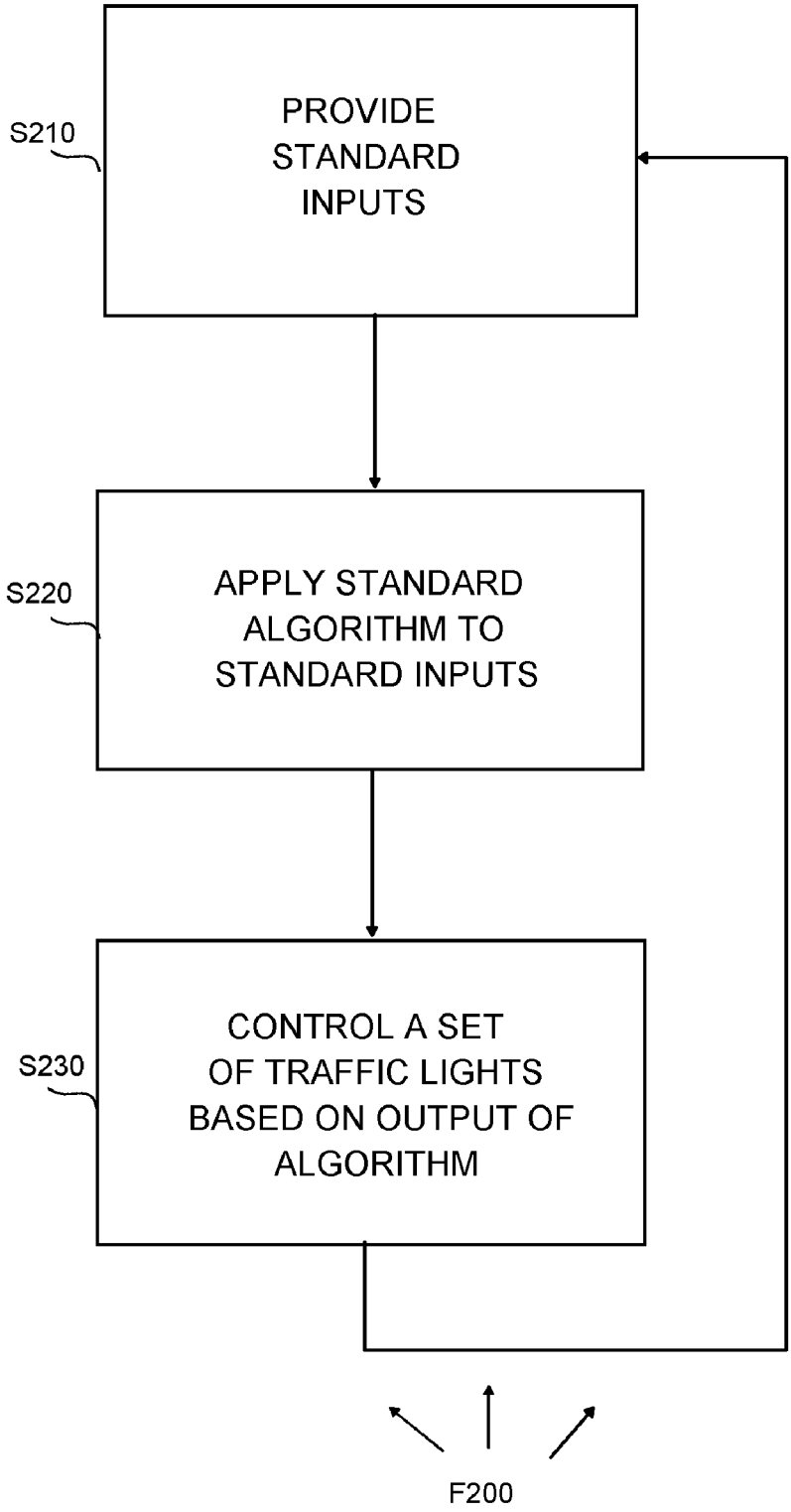
FIG. 2 PRIOR ART
FIG. 2 is a flowchart illustrating a conventional method for controlling a set of traffic lights based on an output of an algorithm.

Reference will now be made in detail to the present preferred embodiments of the invention, examples of which are illustrated in the accompanying drawings, wherein like reference numerals refer to like components.

Figure 3:
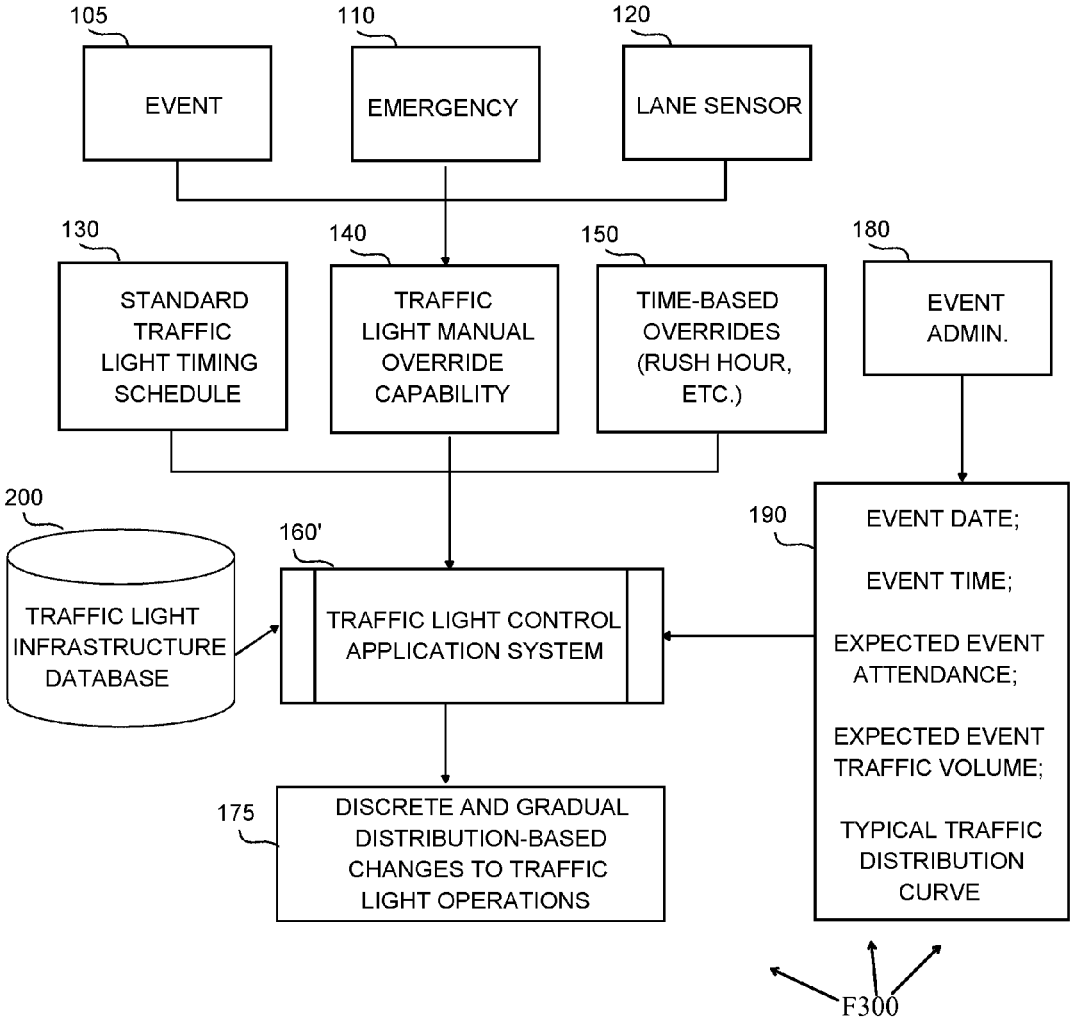
FIG. 3 is a flowchart illustrating a traffic light control system, according to an embodiment of the present invention.

In FIG. 3, a flowchart F300 illustrating a traffic light control system for controlling at least a first traffic light is shown, according to an embodiment of the present invention. The traffic light control system 160' is shown interconnected to the plurality of input modules. Input modules are shown and can include a standard traffic light timing schedule input module 130 (including static timing schedules which are in effect the majority of the time), time-based overrides input module 150 (including discrete changes which take effect over a predefined time interval such as rush hour), and traffic light manual override capability input module 140. The traffic light manual override capability input module 140 can be interconnected to three manual override input modules, including event manual override input module 105 (e.g., manual overrides by event traffic control personnel), emergency vehicle activation manual override input module 110, and lane sensor manual override input module 120. The input modules can also include a traffic light infrastructure database input module 200, which includes a database of traffic light locations and default timing schedules as an input to a traffic light control system 160'.

FIG. 3 also shows an event administrator module 180. The event administrator module 180 can be structured and/or programmed to receive and/or determine a plurality of input parameters/variables received from the input modules. A person, such as an event administrator, attendant, or event control personnel can input parameters/variables and statistical distribution characterization (beta distribution, normal "bell curve" distribution, etc.) data 190 regarding a particular event into the event administrator module 180. In turn, the event administrator module 180 is authorized to transmit the parameters/variables and statistical distribution characterization data 190 regarding a particular event to the traffic light control system 160'. This is also known as input variables or transactional data 190 being transmitted from the event administrator 180 to the traffic light control system 160'. The data includes information related to the event including the event date, time, location, expected attendance, and expected traffic volume. The traffic light control system 160' can also include a traffic light control algorithm module (not shown) structured and/or programmed to receive the input variables 190 from the event administrator module 180, to determine light status control information for a first traffic light, and to output the light status control information to the first traffic light to control operation of the first traffic light. The plurality of input variables can include at least a first event prediction related variable, as detailed in the Summary section.

In contrast to conventional systems, an embodiment of the present invention is predictive and does not need to rely on real-time sensor equipment and the like. In accordance with an embodiment of the present invention, information (input variables 190) regarding an event (e.g., a major league baseball game) may be entered into the event administrator module 180 by an event administrator. The event administrator module 180 is structured/programmed to receive the plurality of input variables 190 and transmit the input variables 190 to the traffic light control application system 160'. The traffic light control application system 160' includes a traffic light control algorithm module (not shown) structured and/or programmed to receive the input variables 190 from the event administrator module 180, to determine light status control information for a first traffic light, and to output the light status control information to the first traffic light to control operation of the first traffic light. Therefore, the system of an embodiment of the present invention has the information that it needs to determine light status control information ahead of time so that it can be predictive.

For example, there may not be too many cars exiting a ballpark after the $6^{th}$ inning, but the system can be proactive (control operation of a first traffic light) and determine that cars need to begin getting out of the vicinity of the ballpark more quickly due to the fact that more fans will start to leave after the $7^{th}$ inning, and so on. The conventional systems are not as timely, and are more reactive to the real-time sensors. These systems will not detect any difference in exiting traffic in the sixth inning vs. any other previous inning, and will not control operation of a first traffic light until such detection is made. Moreover, the system of an embodiment of the present invention is structured/programmed to control operation of a first traffic light in a manner that anticipates traffic levels leaving the ball park will be decreasing before any sensor could detect an actual decrease. In short, the system of an embodiment of the present invention, which is predictive, is able to change traffic patterns in a more gradual manner, and earlier than conventional systems otherwise would.

In contrast to conventional systems, the event administrator module 180 of an embodiment of the present invention is programmed and/or structured to cause the traffic light control system 160' to accommodate and incorporate gradual timing adaptation to traffic volume which is known or expected to build up and settle down, typically following the end of scheduled events. That is, input variables 190 transferred from the event administrator module 180 to the traffic light control application system 160' results in a gradual change(s) to traffic light operations 175. These additional input variables from authorized event administrators are included in the calculations to provide a distribution-based influence on the otherwise discrete changes in traffic light timing. Combining the transactional information 190 provided by the event administrators 180 with the traffic light infrastructure database information 200 as input to the central traffic light control system 160', the effects on subsequent "downstream" traffic lights of applying a distribution-based gradual change to a single traffic light can be calculated and also applied to the "downstream" traffic lights to optimize traffic.

Figure 4:
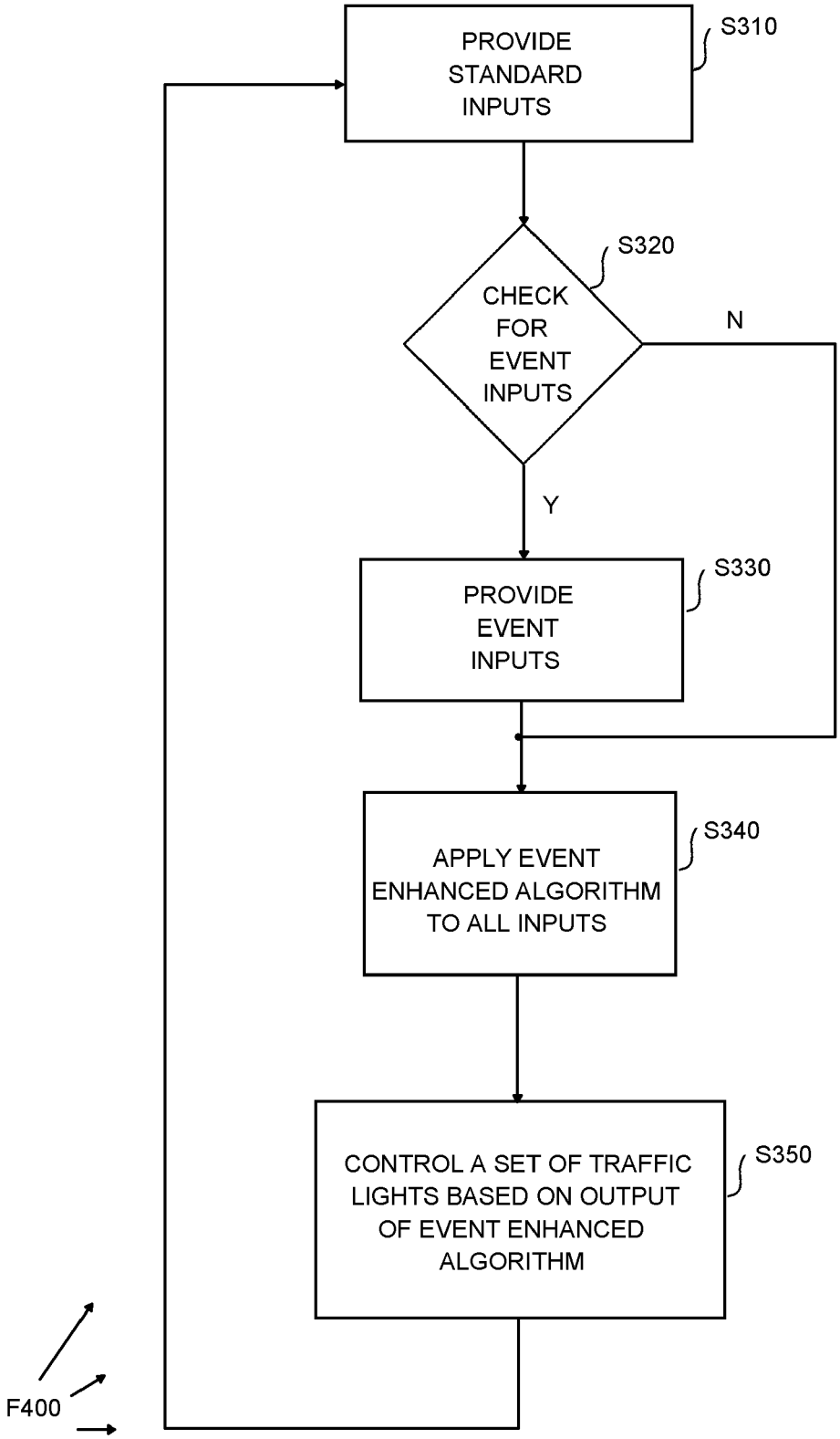
FIG. 4 is a flowchart illustrating a method for controlling a set of traffic lights based on an output of an algorithm, according to an embodiment of the present invention.

In FIG. 4, a flowchart F400 illustrating a method for controlling a set of traffic lights based on an output of an algorithm is provided, according to an embodiment of the present invention, and includes steps S310, S320, S330, S340, and S350.

Figure 5:
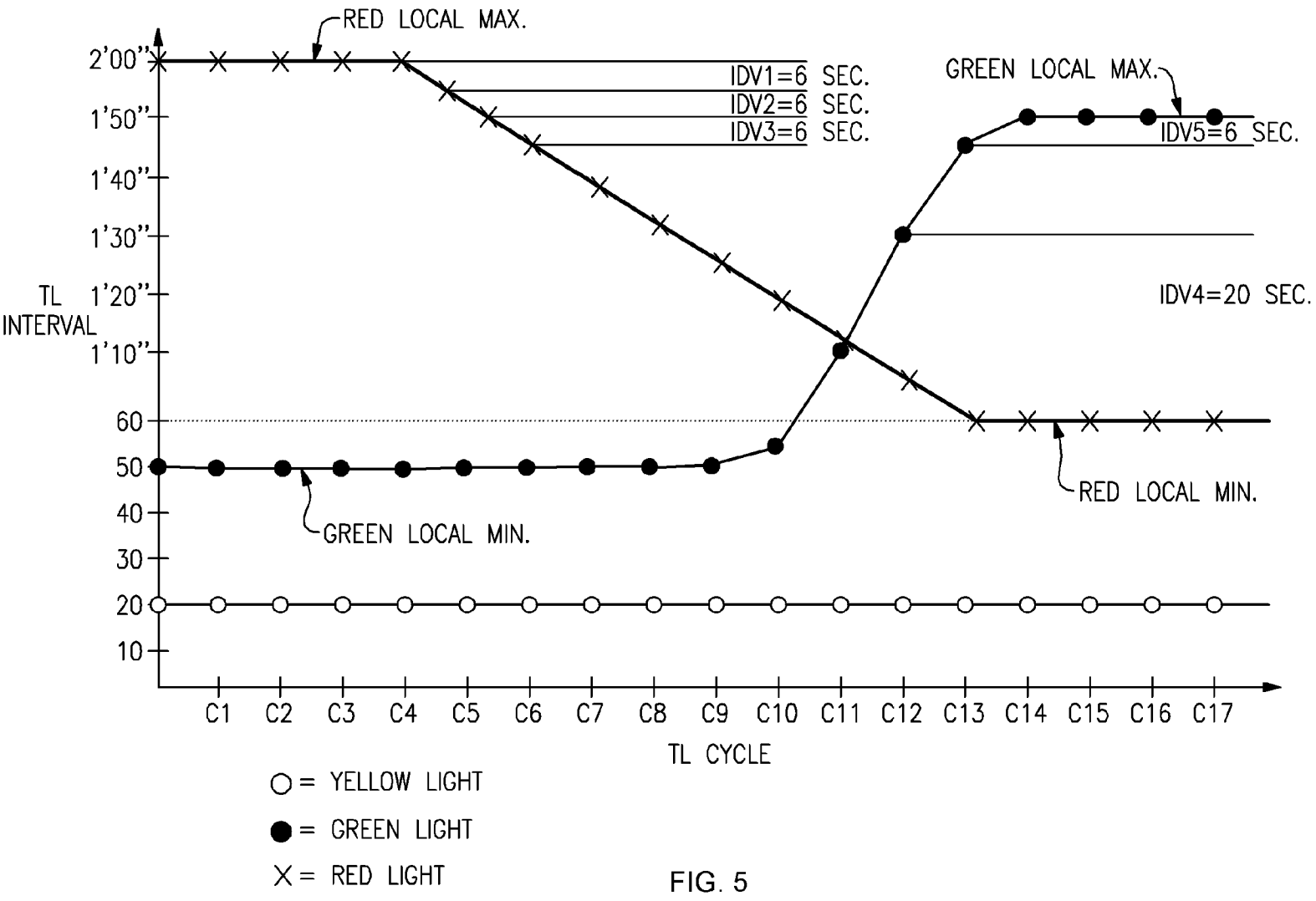
FIG. 5 is a graphical representation of a traffic light interval (for red, yellow, and green light intervals) versus a traffic light cycle, according to an embodiment of the present invention.

The following discussion relates to another embodiment of the present invention. This embodiment relates to traffic light cycles, traffic light intervals, interval delta values, and changes in traffic light intervals in at least a minimally continuous manner, a moderately continuous manner, or a very continuous manner effectuated by a traffic light control system of an embodiment of the present invention. As shown in FIG. 5, a graphical representation of a traffic light interval ("TL Interval"—for red, yellow, and green light intervals) versus a traffic light cycle ("TL Cycle") is illustrated, according to an embodiment of the present invention.

FIG. 5 shows how a traffic light interval may be changed in a gradual, non-abrupt and non-discrete manner. The traffic light cycles ("C") are listed as C1 to C17. Each traffic light interval is marked within a two minute time frame with respect to a particular traffic light cycle, and a particular traffic light color. The addition of the red, yellow and green traffic light intervals for each traffic light cycle, equals the traffic light cycle time. For example, for C1: red=2:00 min.; yellow=20 sec.; and green=50 sec. for a traffic light cycle time of 3:10 min. The red light local maximum is shown as 2:00 min., and the red light local minimum is shown as 60 sec., defining a range for the red traffic light interval of 1:00 minute. The green local maximum is shown as 1:50 min., and the green light local minimum is shown as 50 sec., defining a range for the green traffic light interval of 1:00 minute (note this is the same range as the red traffic light interval, however, these ranges may be different). The yellow light is fixed at 20 sec. in FIG. 5, and thus no local maximum, no local minimum, and no range is noted.

FIG. 5 also shows various interval delta values ("IDV") for the red light and the green light. For example, IDV1-IDV3 are shown as representative IDVs for the red light. Each of IDV1-IDV3 equals 6 sec. Each of these IDVs meets the definition of a moderately continuous manner as provided herein, i.e., the IDV is greater than one twenty-fifth and no more than one tenth of the value of the range. Here, each IDV (IDV1-IDV3) is one tenth of the value of the range (6 sec. IDV/60 sec. range=0.10). IDV4 is shown as a representative IDV for the green light. IDV4 equals 20 sec. This IDV meets the definition of a minimally continuous manner as provided herein, i.e., the IDV is greater than one tenth and no more than one third of the value of the range. Here, IDV4 is one third of the value of the range (20 sec./60 sec.=0.33). IDV5 is also shown as a representative IDV for the green light. IDV5 equals 6 sec. This IDV meets the definition of a moderately continuous manner as provided herein, i.e., the IDV is greater than one twenty-fifth and no more than one tenth of the value of the range. Here, IDV5 is one tenth of the value of the range (6 sec. IDV/60 sec. range=0.10). Unlike the values for the representative red light IDVs, the values for the representative green light IDVs, IDV4 and IDV5, are different.

Figure 6:
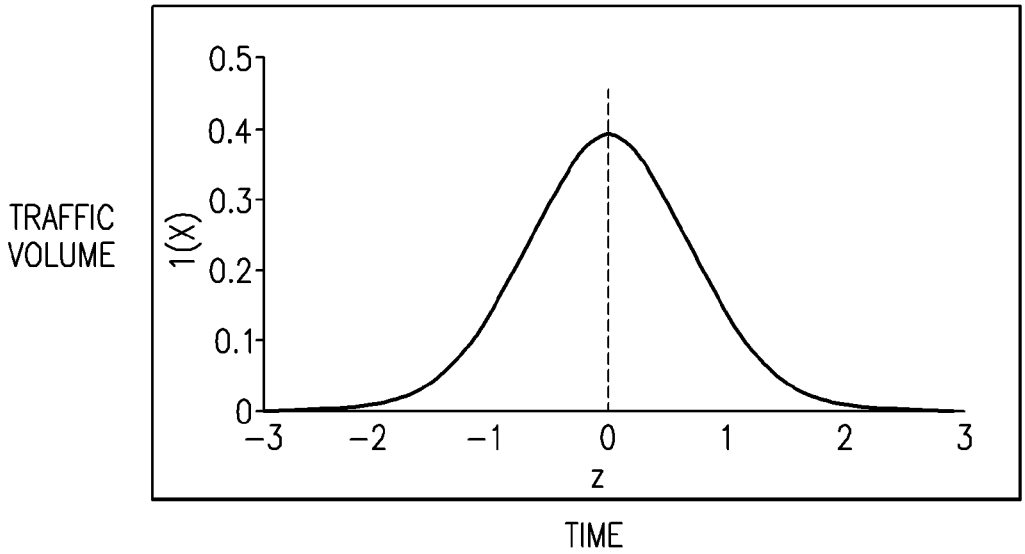
FIG. 6 is a normal distribution curve illustrating traffic volume vs. time.
Figure 7:
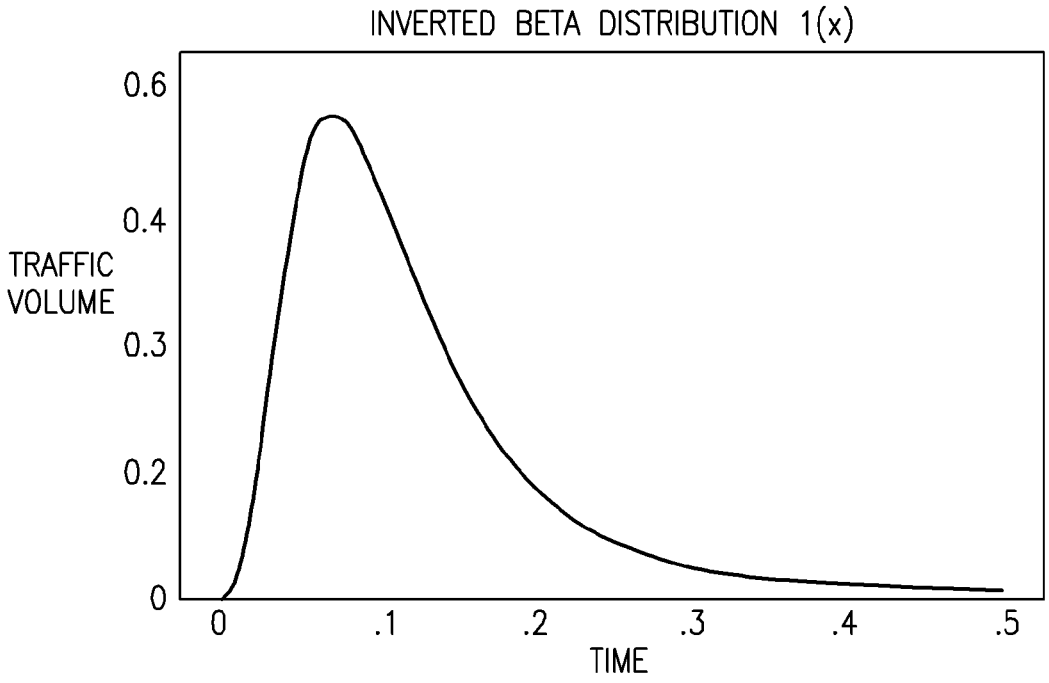
FIG. 7 is a beta-distribution curve illustrating traffic volume vs. time.

An input variable, such as an expected event traffic statistical distribution curve, can be determined by a study of the nature of typical events. For example, at a major league baseball game in a major city, exiting traffic may slowly start to build up beginning in the seventh inning, rise to a peak after the ninth inning, and gradually decline as the stragglers make their way out of the ballpark. This behavior of the existing traffic would closely resemble a normal statistical distribution standard bell curve, as shown in FIG. 6. On the other hand, suppose a popular rock concert is held in the same venue. Typically, fewer vehicles will leave early, with a sudden large increase in traffic after the concert concludes, gradually tapering off towards normal traffic volume levels. This would more closely resemble an inverted beta-distribution curve, as shown in FIG. 7.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

DEFINITIONS

The following definitions are provided to facilitate claim interpretation:

Present invention: means at least some embodiments of the present invention; references to various feature(s) of the "present invention" throughout this document do not mean that all claimed embodiments or methods include the referenced feature(s).

First, second, third, etc. ("ordinals"): Unless otherwise noted, ordinals only serve to distinguish or identify (e.g., various members of a group); the mere use of ordinals implies neither a consecutive numerical limit nor a serial limitation.

Event prediction related variable: a predictive parameter related to predicted traffic flow that is based on a planned event; event prediction related variables include, but are not necessarily limited to: event date, event time, event location, event expected attendance, expected event traffic volume, and/or expected event traffic distribution curve.

Traffic light: a set of lights designed to control pedestrian or vehicular traffic along one traffic channel (for example, a lane of traffic, a crosswalk); a "traffic light" may occupy a common housing with other traffic lights (for example, a traffic light for controlling a parallel lane of traffic, a traffic light for controlling an intersecting lane of traffic).

Normal operations: if a traffic light is manually over-ridden that is an example of the traffic light not being in a mode of normal operations; if a traffic light switches from one operational mode (for example, green-flashing green-red) to a different operational mode (for example, flashing yellow), then this would not be considered to be normal operations.

Traffic light cycle: a period of time between the time a controlled traffic light first switches to a first status and the next time the traffic light switches to that first status; during normal operations, an operational mode remains constant one successive cycle to the next, even though the time period of the traffic light cycle and/or its constituent traffic light intervals may change.

Traffic light interval: a period of time within a traffic light cycle where the constituent lights occupy a given status; for example, during a three traffic light interval traffic light cycle there may be a green light on interval, a yellow light on interval and a red light on interval; as a further example, another three traffic light interval traffic light cycle may be made of a walk light signal, a flashing walk light signal and a don't walk light signal; it is noted that the different statuses for a countdown timer (for example, a countdown timer associated with a walk light) are not considered as a "traffic light interval."

Interval delta value: Any non-zero change in a traffic light interval a given cycle and the same traffic light interval in the immediately previous cycle; during normal operations, a series of successive cycles will result in a series of interval delta values for each interval making up the cycle (unless an interval happens to have a constant value from cycle to cycle).

Minimally continuous manner: When: (i) a traffic light interval changes over successive cycles from one local extreme (local minimum or local maximum) to the next local extreme; (ii) with the difference between the local extremes being called the range; and (iii) each interval delta value is greater than one tenth and no more than one third of the value of the range.

Moderately continuous manner: When: (i) a traffic light interval changes over successive cycles from one local extreme (local minimum or local maximum) to the next local extreme; (ii) with the difference between the local extremes being called the range; and (iii) each interval delta value is greater than one twenty-fifth and no more than one tenth of the value of the range.

Very continuous manner: When: (i) a traffic light interval changes over successive cycles from one local extreme (local minimum or local maximum) to the next local extreme; (ii) with the difference between the local extremes being called the range; and (iii) each interval delta value is no more than one twenty-fifth of the value of the range.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control. If the definitions provided above are broader than the ordinary, plain, and accustomed meanings in some aspect, then the above definitions shall be considered to broaden the claim accordingly.

To the extent that a patentee may act as its own lexicographer under applicable law, it is hereby further directed that all words appearing in the claims section, except for the above-defined words, shall take on their ordinary, plain, and accustomed meanings (as generally shown by documents such as dictionaries and/or technical lexicons), and shall not be considered to be specially defined in this specification. In the situation where a word or term used in the claims has more than one alternative ordinary, plain and accustomed meaning, the broadest definition that is consistent with technological feasibility and not directly inconsistent with the specification shall control.

Unless otherwise explicitly provided in the claim language, steps in method steps or process claims need only be performed in the same time order as the order the steps are recited in the claim only to the extent that impossibility or extreme feasibility problems dictate that the recited step order (or portion of the recited step order) be used. This broad interpretation with respect to step order is to be used regardless of whether the alternative time ordering(s) of the claimed steps is particularly mentioned or discussed in this document.

What is claimed is:

1. A traffic light control system for controlling a first traffic light, the system comprising:

an event administrator module structured and/or programmed to receive and/or determine a plurality of input variables; and a traffic light control algorithm module structured and/or programmed to receive the input variables from the event administrator module, to determine light status control information for the first traffic light, and to output the light status control information to the first traffic light to control operation of the first traffic light;

wherein the plurality of input variables includes at least a first event prediction related variable.

2. The system of claim 1, wherein the first event prediction related variable is a first vehicle access arrival frequency variable.

3. The system of claim 1, wherein the plurality of input variables includes at least a second event prediction related variable.

4. The system of claim 3, wherein the second event prediction related variable is a second vehicle access arrival frequency variable.

5. The system of claim 1, wherein the first event prediction related variable is a date of an event.

6. The system of claim 1, wherein the first event prediction related variable is a time of an event.

7. The system of claim 1, wherein the first event prediction related variable is an event location.

8. The system of claim 1, wherein the first event prediction related variable is an expected event attendance.

9. The system of claim 1, wherein the first event prediction related variable is an expected event traffic volume.

10. The system of claim 1, wherein the first event prediction related variable is an expected event traffic distribution curve.

11. A traffic light control system for controlling a first traffic light, the system comprising:

an event administrator module structured and/or programmed to receive and/or determine a plurality of input variables; and a traffic light control algorithm module structured and/or programmed to receive the input variables from the event administrator module, to determine light status control information for the first traffic light, and to output the light status control information to the first traffic light to control operation of the first traffic light;

wherein:

the light status control information effectively determines a traffic light cycle, a plurality of traffic light intervals occurring within each traffic light cycle and a plurality of interval delta values according to the plurality of traffic light intervals; and during at least some portions of normal operations, the traffic light control algorithm module determines light status control information so that at least one of the plurality of traffic light intervals changes in an at least a minimally continuous manner.

12. The system of claim 11 wherein during at least some portions of normal operations, the traffic light control algorithm determines light status control information so that the first traffic light interval changes in an at least a moderately continuous manner.

13. The system of claim 11 wherein during at least some portions of normal operations, the traffic light control algorithm determines light status control information so that the first traffic light interval changes in an at least a very continuous manner.

14. A method of controlling accumulation of vehicular traffic at an intersection comprising the steps of:

providing data concerning a first access to the intersection;

calculating a first vehicle access arrival frequency function for vehicles entering the intersection from the first access;

providing a control mechanism to control vehicles leaving the intersection from the first access, the control mechanism having a control function; and modifying the control function based on changes to the first vehicle access arrival frequency function.

15. The method of claim 14, further comprising the step of providing data concerning a second access to the intersection.

16. The method of claim 15, further comprising the step of calculating a second vehicle access arrival frequency function of vehicles entering the intersection from the second access.

17. The method of claim 16, wherein the control mechanism is programmed and/or structured to control vehicles leaving the intersection from the second access.

18. The method of claim 17, further comprising the step of modifying the control function based on changes to the second vehicle access arrival frequency function.

* * * * *